US007942219B2

(12) United States Patent
Keshavan et al.

(10) Patent No.: US 7,942,219 B2
(45) Date of Patent: May 17, 2011

(54) POLYCRYSTALLINE DIAMOND CONSTRUCTIONS HAVING IMPROVED THERMAL STABILITY

(75) Inventors: Madapusi K. Keshavan, The Woodlands, TX (US); Ronald K. Eyre, Orem, UT (US); Anthony Griffo, The Woodlands, TX (US); Peter Thomas Cariveau, Draper, UT (US)

(73) Assignee: Smith International, Inc., Houston, TX (US)

( * ) Notice: Subject to any disclaimer, the term of this patent is extended or adjusted under 35 U.S.C. 154(b) by 197 days.

(21) Appl. No.: 11/689,434

(22) Filed: Mar. 21, 2007

(65) Prior Publication Data

US 2008/0230280 A1 Sep. 25, 2008

(51) Int. Cl.
*E21B 10/46* (2006.01)

(52) U.S. Cl. ..... 175/434

(58) Field of Classification Search ..... 175/434
See application file for complete search history.

(56) References Cited

U.S. PATENT DOCUMENTS

| | | | |
|---|---|---|---|
| 3,136,615 | A | 6/1964 | Bovenkerk et al. |
| 3,141,746 | A | 7/1964 | Lai |
| 3,233,988 | A | 2/1966 | Wentorf, Jr. et al. |
| 3,745,623 | A | 7/1973 | Wentorf, Jr. et al. |
| 4,108,614 | A | 8/1978 | Mitchell |
| 4,151,686 | A | 5/1979 | Lee et al. |
| 4,224,380 | A | 9/1980 | Bovenkerk et al. |
| 4,255,165 | A | 3/1981 | Dennis et al. |
| 4,268,276 | A | 5/1981 | Bovenkerk |
| 4,288,248 | A | 9/1981 | Bovenkerk et al. |
| 4,303,442 | A | 12/1981 | Hara et al. |
| 4,311,490 | A | 1/1982 | Bovenkerk et al. |
| 4,373,593 | A | 2/1983 | Phaal et al. |
| 4,387,287 | A | 6/1983 | Marazzi |
| 4,412,980 | A | 11/1983 | Tsuji et al. |
| 4,481,016 | A | 11/1984 | Campbell et al. |
| 4,486,286 | A | 12/1984 | Lewin et al. |
| 4,504,519 | A | 3/1985 | Zelez |
| 4,522,633 | A | 6/1985 | Dyer |

(Continued)

FOREIGN PATENT DOCUMENTS

| | | |
|---|---|---|
| EP | 0300699 | 1/1989 |

(Continued)

OTHER PUBLICATIONS

UK Search Report dated Jul. 17, 2008, 4 pages.

(Continued)

*Primary Examiner* — Jennifer H Gay
*Assistant Examiner* — Brad Harcourt
(74) *Attorney, Agent, or Firm* — Osha Liang LLP

(57) ABSTRACT

PCD constructions include a PCD body comprising a polycrystalline matrix region, a first region that includes a replacement material positioned remote from a body surface, and a second region that is substantially free of the replacement material and that extends a depth from the body surface. The PCD construction can further include a substrate that is attached to the body. The PCD body is formed by removing a solvent catalyst material used to form the body, replacing the removed solvent catalyst material with a replacement material, and then removing the replacement material from a region of the body to thereby form the second region. The replacement material can be introduced into the PCD body during a HPHT process, and the substrate may or may not be the source of the noncatalyzing material.

37 Claims, 5 Drawing Sheets

U.S. PATENT DOCUMENTS 4,525,179 A 6/1985 Gigl
4,534,773 A 8/1985 Phaal et al.
4,556,403 A 12/1985 Almond et al.
4,560,014 A 12/1985 Geczy
4,570,726 A 2/1986 Hall
4,572,722 A 2/1986 Dyer
4,604,106 A 8/1986 Hall
4,605,343 A 8/1986 Hibbs, Jr. et al.
4,606,738 A 8/1986 Hayden
4,621,031 A 11/1986 Scruggs
4,636,253 A 1/1987 Nakai et al.
4,645,977 A 2/1987 Kurokawa et al.
4,662,348 A 5/1987 Hall et al.
4,664,705 A 5/1987 Horton et al.
4,670,025 A 6/1987 Pipkin
4,707,384 A 11/1987 Schachner et al.
4,726,718 A 2/1988 Meskin et al.
4,766,040 A 8/1988 Hillert et al.
4,776,861 A 10/1988 Frushour
4,784,023 A 11/1988 Dennis
4,792,001 A 12/1988 Zijsling
4,793,828 A 12/1988 Burnand
4,797,241 A 1/1989 Peterson et al.
4,802,539 A 2/1989 Hall et al.
4,807,402 A 2/1989 Rai
4,828,582 A 5/1989 Frushour
4,844,185 A 7/1989 Newton, Jr. et al.
4,861,350 A 8/1989 Phaal et al.
4,871,377 A 10/1989 Frushour
4,882,128 A 11/1989 Hukvari et al.
4,899,922 A 2/1990 Slutz et al.
4,919,220 A 4/1990 Fuller et al.
4,931,068 A 6/1990 Dismukes et al.
4,933,529 A 6/1990 Saville et al.
4,940,180 A 7/1990 Martell
4,943,488 A 7/1990 Sung et al.
4,944,772 A 7/1990 Cho
4,976,324 A 12/1990 Tibbitts
5,011,514 A 4/1991 Cho et al.
5,027,912 A 7/1991 Juergens
5,030,276 A 7/1991 Sung et al.
5,032,147 A 7/1991 Frushour
5,068,148 A 11/1991 Nakahara et al.
5,092,687 A 3/1992 Hall
5,116,568 A 5/1992 Sung et al.
5,127,923 A 7/1992 Bunting et al.
5,135,061 A 8/1992 Newton, Jr.
5,176,720 A 1/1993 Martell et al.
5,186,725 A 2/1993 Martell et al.
5,199,832 A 4/1993 Meskin et al.
5,205,684 A 4/1993 Meskin et al.
5,213,248 A 5/1993 Horton et al.
5,238,074 A 8/1993 Tibbitts et al.
5,264,283 A 11/1993 Waldenstrom et al.
5,337,844 A 8/1994 Tibbitts
5,369,034 A 11/1994 Hargett et al.
5,370,195 A 12/1994 Keshavan et al.
5,379,853 A 1/1995 Lockwood et al.
5,439,492 A 8/1995 Anthony et al.
5,464,068 A 11/1995 Najafi-Sani
5,468,268 A 11/1995 Tank et al.
5,496,638 A 3/1996 Waldenstrom et al.
5,505,748 A 4/1996 Tank et al.
5,510,193 A 4/1996 Cerutti et al.
5,523,121 A 6/1996 Anthony et al.
5,524,719 A 6/1996 Dennis
5,560,716 A 10/1996 Tank et al.
5,607,024 A 3/1997 Keith et al.
5,620,382 A 4/1997 Cho et al.
5,624,068 A 4/1997 Waldenstrom et al.
5,645,617 A 7/1997 Frushour
5,667,028 A 9/1997 Truax et al.
5,718,948 A 2/1998 Ederyd et al.
5,722,499 A 3/1998 Nguyen et al.
5,776,615 A 7/1998 Wong et al.
5,833,021 A 11/1998 Mensa-Wilmot et al.
5,897,942 A 4/1999 Karner et al.
5,954,147 A 9/1999 Overstreet et al.
5,979,578 A 11/1999 Packer
6,009,963 A 1/2000 Chaves et al.
6,063,333 A 5/2000 Dennis
6,123,612 A 9/2000 Goers
6,126,741 A 10/2000 Jones et al.
6,165,616 A 12/2000 Lemelson
6,193,001 B1 * 2/2001 Eyre et al. ..... 175/432
6,202,770 B1 3/2001 Jurewicz et al.
6,234,261 B1 5/2001 Evans et al.
6,248,447 B1 6/2001 Griffin et al.
6,269,894 B1 8/2001 Griffin
6,302,225 B1 10/2001 Yoshida et al.
6,344,149 B1 2/2002 Oles
6,410,085 B1 6/2002 Griffin et al.
6,435,058 B1 8/2002 Matthias et al.
6,443,248 B2 9/2002 Yong et al.
6,544,308 B2 4/2003 Griffin et al.
6,562,462 B2 5/2003 Griffin et al.
6,585,064 B2 7/2003 Griffin et al.
6,589,640 B2 7/2003 Griffin et al.
6,592,985 B2 7/2003 Griffin et al.
6,601,662 B2 8/2003 Matthias et al.
6,739,214 B2 5/2004 Griffin et al.
6,749,033 B2 6/2004 Griffin et al.
6,797,326 B2 9/2004 Griffin et al.
6,892,836 B1 5/2005 Eyre
7,377,341 B2 5/2008 Middlemiss et al.
7,464,993 B2 * 12/2008 Hall et al. ..... 299/113
7,635,035 B1 * 12/2009 Bertagnolli et al. ..... 175/434
2004/0244540 A1 * 12/2004 Oldham et al. ..... 76/108.2
2005/0050801 A1 3/2005 Cho
2005/0129950 A1 6/2005 Griffin et al.
2005/0230156 A1 10/2005 Belnap et al.
2005/0263328 A1 12/2005 Middlemiss
2006/0060390 A1 3/2006 Eyre
2006/0060392 A1 3/2006 Eyre et al.
2006/0165993 A1 7/2006 Keshavan
2007/0079994 A1 * 4/2007 Middlemiss ..... 175/426
2007/0169419 A1 7/2007 Davis et al.
2007/0181348 A1 8/2007 Lancaster et al.
2008/0085407 A1 4/2008 Cooley et al.
2008/0115421 A1 * 5/2008 Sani ..... 51/295
2008/0142276 A1 6/2008 Griffo
2008/0185189 A1 8/2008 Griffo et al.
2008/0223621 A1 9/2008 Middlemiss et al.
2008/0223623 A1 9/2008 Keshavan et al.
2009/0032169 A1 2/2009 Dourfaye et al.
2009/0133938 A1 * 5/2009 Hall et al. ..... 175/434

FOREIGN PATENT DOCUMENTS

EP 0329954 8/1989
EP 0500253 8/1992
EP 0595630 5/1994
EP 0612868 8/1994
EP 0617207 9/1994
EP 0714695 A2 6/1996
EP 0787820 8/1997
EP 0860515 8/1998
EP 1064991 A2 1/2001
EP 1116858 7/2001
EP 1190791 3/2002
EP 1958688 8/2008
EP 2032243 A1 3/2009
GB 1349385 4/1974
GB 2048927 12/1980
GB 2268768 1/1994
GB 2270493 3/1994
GB 2323398 9/1998
GB 2351747 1/2001
GB 2367081 3/2002
GB 2408735 6/2005
GB 2413575 11/2005
GB 2 418 215 3/2006
GB 2422623 8/2006
GB 2427215 12/2006
GB 2429471 2/2007
GB 2429727 3/2007
GB 2438073 11/2007
GB 2455425 A 6/2009

| | | |
|---|---|---|
| JP | 59219500 | 12/1984 |
| JP | 60187603 | 9/1985 |
| WO | 9323204 | 11/1993 |
| WO | 9634131 | 10/1996 |
| WO | WO 00/28106 | 5/2000 |
| WO | 2004040095 | 5/2004 |
| WO | 2004106003 | 12/2004 |
| WO | 2004106004 | 12/2004 |
| WO | 2007042920 | 4/2007 |

OTHER PUBLICATIONS

Search Report and Opinion for EP 08101339.3 dated May 30, 2008, total 10 pages.

US Office Action issued in U.S. Appl. No. 12/026,398 dated Mar. 13, 2009 (9 pages).

EP Communication issued in Application No. 08101339.3 dated Jan. 15, 2009 (8 pages).

GB Examination Report issued in Application No. GB0916520.0 dated Oct. 23, 2009 (1 page).

GB Search Report issued in Application No. GB0916520.0 dated Oct. 22, 2009 (1 page).

U.S. Office Action issued in U.S. Appl. No. 12/026,398 on Nov. 20, 2009 (12 pages).

Combined Search and Examination Report under Sections 17 and 18(3) issued Jul. 15, 2010 by the UK Intellectual Property Office in corresponding application No. GB1010841.3 (4 pages).

* cited by examiner

POLYCRYSTALLINE DIAMOND CONSTRUCTIONS HAVING IMPROVED THERMAL STABILITY

FIELD OF THE INVENTION

This invention relates to polycrystalline diamond constructions, and methods for forming the same, that are specially engineered having differently composed regions for the purpose of providing improved thermal characteristics when used, e.g., as a cutting element or the like, during cutting and/or wear applications when compared to conventional polycrystalline diamond constructions comprising a solvent catalyst material.

BACKGROUND OF THE INVENTION

The existence and use polycrystalline diamond material types for forming tooling, cutting and/or wear elements is well known in the art. For example, polycrystalline diamond (PCD) is known to be used as cutting elements to remove metals, rock, plastic and a variety of composite materials. Such known polycrystalline diamond materials have a microstructure characterized by a polycrystalline diamond matrix first phase, that generally occupies the highest volume percent in the microstructure and that has the greatest hardness, and a plurality of second phases, that are generally filled with a solvent catalyst material used to facilitate the bonding together of diamond grains or crystals together to form the polycrystalline matrix first phase during sintering.

PCD known in the art is formed by combining diamond grains (that will form the polycrystalline matrix first phase) with a suitable solvent catalyst material (that will form the second phase) to form a mixture. The solvent catalyst material can be provided in the form of powder and mixed with the diamond grains or can be infiltrated into the diamond grains during high pressure/high temperature (HPHT) sintering. The diamond grains and solvent catalyst material is sintered at extremely high pressure/high temperature process conditions, during which time the solvent catalyst material promotes desired intercrystalline diamond-to-diamond bonding between the grains, thereby forming a PCD structure.

Solvent catalyst materials used for forming conventional PCD include solvent metals from Group VIII of the Periodic table, with cobalt (Co) being the most common. Conventional PCD can comprise from about 85 to 95% by volume diamond and a remaining amount being the solvent metal catalyst material. The solvent catalyst material is present in the microstructure of the PCD material within interstices or interstitial regions that exist between the bonded together diamond grains and/or along the surfaces of the diamond crystals.

The resulting PCD structure produces enhanced properties of wear resistance and hardness, making PCD materials extremely useful in aggressive wear and cutting applications where high levels of wear resistance and hardness are desired. Industries that utilize such PCD materials for cutting, e.g., in the form of a cutting element, include automotive, oil and gas, aerospace, nuclear and transportation to mention only a few.

For use in the oil production industry, such PCD cutting elements are provided in the form of specially designed cutting elements such as shear cutters that are configured for attachment with a subterranean drilling device, e.g., a shear or drag bit. Thus, such PCD shear cutters are used as the cutting elements in shear bits that drill holes in the earth for oil and gas exploration. Such shear cutters generally comprise a PCD body that is joined to substrate, e.g., a substrate that is formed from cemented tungsten carbide. The shear cutter is manufactured using an ultra-high pressure/temperature process that generally utilizes cobalt as a catalytic second phase material that facilitates liquid-phase sintering between diamond particles to form a single interconnected polycrystalline matrix of diamond with cobalt dispersed throughout the matrix.

The shear cutter is attached to the shear bit via the substrate, usually by a braze material, leaving the PCD body exposed as a cutting element to shear rock as the shear bit rotates. High forces are generated at the PCD/rock interface to shear the rock away. In addition, high temperatures are generated at this cutting interface, which shorten the cutting life of the PCD cutting edge. High temperatures incurred during operation cause the cobalt in the diamond matrix to thermally expand and even change phase (from BCC to FCC), which thermal expansion is known to cause the diamond crystalline bonds within the microstructure to be broken at or near the cutting edge, thereby also operating to reduces the life of the PCD cutter. Also, in high temperature oxidizing cutting environments, the cobalt in the PCD matrix will facilitate the conversion of diamond back to graphite, which is also known to radically decrease the performance life of the cutting element.

Attempts in the art to address the above-noted limitations have largely focused on the solvent catalyst material's degradation of the PCD construction by catalytic operation, and removing the catalyst material therefrom for the purpose of enhancing the service life of PCD cutting elements. For example, it is known to treat the PCD body to remove the solvent catalyst material therefrom, which treatment has been shown to produce a resulting diamond body having enhanced cutting performance. One known way of doing this involves at least a two-stage technique of first forming a conventional sintered PCD body, by combining diamond grains and a solvent catalyst material and subjecting the same to HPHT process as described above, and then removing the solvent catalyst material therefrom, e.g., by acid leaching process.

Known approaches include removing substantially all of the solvent catalyst material from the PCD body so that the remaining PCD body comprises essential a matrix of diamond bonded crystals with no other material occupying the interstitial regions between the diamond crystals. While the so-formed PCD body may display improved thermal properties, it now lacks toughness that may make it unsuited for particular high-impact cutting and/or wear applications. Additionally, it is difficult to attached such so-formed PCD bodies to substrates to form a PCD compact. The construction of a compact having such a substrate is desired because it enables attachment of the PCD cutter to a cutting and/or wear device by conventional technique, such as welding, brazing or the like. Without a substrate, the so-formed PCD body must be attached to the cutting and/or wear device by interference fit, which is not practical and does not provide a strong attachment to promote a long service life.

Other known approaches include removing the solvent catalyst material from only a region of the PCD body that may be located near a working or cutting surface of the body. In this case, the PCD body includes this region that is substantially free of the solvent catalyst material extending a distance from the working or cutting surface, and another region that includes the solvent catalyst material. The presence of the solvent catalyst material in the remaining region facilitates attachment of the PCD body to a substrate to promote attachment with cutting and/or wear devices. However, the presence of the catalyst solvent material in such PCD construction, even though restricted to a particular region of the PCD body, can present the same types of unwanted problems noted above during use in a cutting and/or wear application under certain extreme operating conditions. Thus, the presence of the solvent catalyst material in the interstitial regions of the PCD body can still cause unwanted thermally-related deterioration of the PCD structure and eventual failure during use.

It is, therefore, desirable that a polycrystalline diamond construction be engineered in a manner that not only has improved thermal characteristics to provide an improved degree of thermal stability when compared to conventional PCD, but that does so in a manner that avoids unwanted deterioration of the PCD body that is known to occur by the presence of a solvent catalyst material in the PCD constructions. It is further desired that such polycrystalline diamond constructions be engineered in a manner that enables the attachment of a substrate thereto, thereby forming a thermally stable polycrystalline diamond compact that facilitates attachment of the polycrystalline diamond compact to cutting and/or wear devices by conventional method, such as by welding, brazing, or the like.

SUMMARY OF THE INVENTION

Polycrystalline diamond construction (PCD) of this invention comprise a plurality of bonded together diamond crystals forming a polycrystalline diamond body. The body includes a surface and has material microstructure comprising a first region positioned remote from the surface and that includes a replacement material. In an example embodiment, the replacement material is a noncatalyzing material that is disposed within interstitial regions between the diamond crystals in the first region. The noncatalyzing material can have a melting temperature of less than about 1,200° C., and can be selected from metallic materials and/or alloys including elements, which can include those from Group IB of the Periodic table, such as copper.

The body further comprises a second region that includes interstitial regions that are substantially free of the replacement or noncatalyzing material. The second region extends from the surface a depth into the body. In an example embodiment, the PCD construction further comprises a substrate that is attached to the body. In an example embodiment, the substrate is attached to the body adjacent the body first region. The substrate can be a cermet material, and can comprise a binder material that is the same as the replacement material. The PCD construction may further include an intermediate material interposed between the body and the substrate.

PCD constructions of this invention can be made by treating a polycrystalline diamond body comprising a plurality of bonded together diamond crystals and a solvent catalyst material to remove the solvent catalyst material, wherein the solvent catalyst material is disposed within interstitial regions between the bonded together diamond crystals. The solvent catalyst material is then replaced with a replacement material, e.g., a noncatalyzing material. The body containing the replacement material is then treated to remove substantially all of the noncatalyzing material from a region of the body extending a depth from a body surface, wherein the during this process the noncatalyzing material is allowed to reside in a remaining region of the body that is remote from the surface. During the process of replacing the solvent catalyst material with the replacement material, a desired substrate may be attached to the body.

PCD constructions of this invention provided in the form of a compact, comprising a body and a substrate attached thereto, can be configured in the form of a cutting element used for attachment with a wear and/or cutting device such as a bit for drilling earthen formations.

PCD constructions prepared in accordance with the principles of this invention display improved thermal characteristics and mechanical properties when compared to conventional PCD constructions, thereby avoiding unwanted deterioration of the PCD body that is known to occur by the presence of the solvent catalyst material in such conventional PCD constructions. PCD constructions of this invention include a substrate attached to a PCD body, thereby enabling attachment of the compact to a cutting and/or wear device by conventional method, such as by welding, brazing, or the like.

BRIEF DESCRIPTION OF THE DRAWINGS

These and other features and advantages of the present invention will be appreciated as the same becomes better understood by reference to the following detailed description when considered in connection with the accompanying drawings wherein.

DETAILED DESCRIPTION

Figure 1A:
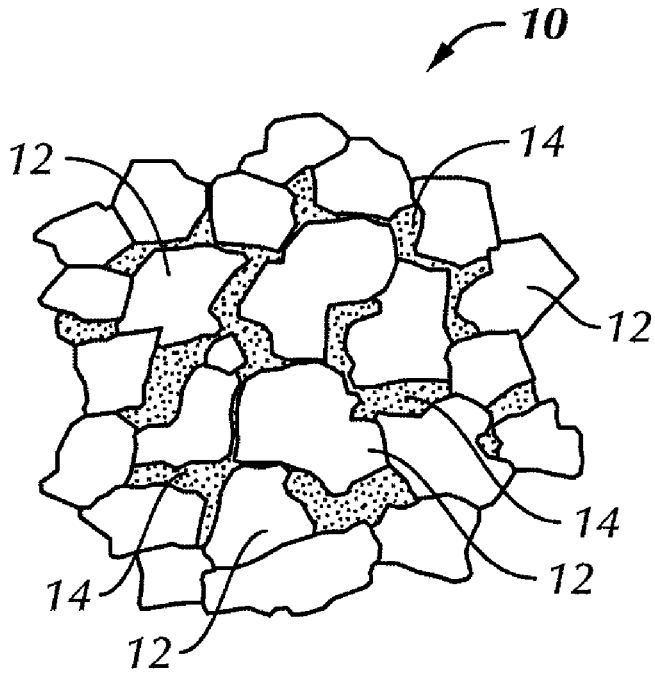
FIG. 1A is a schematic view of a region taken from a polycrystalline diamond body comprising a replacement material disposed interstitially between bonded together diamond crystals.

Polycrystalline diamond (PCD) constructions of this invention have a material microstructure comprising a polycrystalline matrix first phase that is formed from bonded together diamond grains or crystals. The diamond body further includes interstitial regions disposed between the diamond crystals, wherein in one region of the body the interstitial regions are filled with a replacement or noncatalyzing material, and wherein in another region of the body the interstitial regions are substantially free of the replacement or noncatalyzing material. The PCD construction can additionally comprise a substrate that is attached to the PCD body, thereby forming a compact. Such PCD constructions and compacts configured in this matter are specially engineered to provide improved thermal characteristics such as thermal stability when exposed to cutting and wear applications when compared to conventional PCD constructions, i.e., those that are formed from and that include solvent metal catalyst materials. PCD compacts of this invention, comprising a substrate attached thereto, facilitate attachment of the construction to a desired tooling, cutting, machining, and/or wear device, e.g., a drill bit used for drilling subterranean formations.

As used herein, the term "PCD" is used to refer to polycrystalline diamond that has been formed at high pressure/high temperature (HPHT) conditions and that has a material microstructure comprising a matrix phase of bonded together diamond crystals. PCD is also understood to include a plurality of interstitial regions that are disposed between the diamond crystals. PCD useful for making PCD constructions of this invention can be formed by conventional method of subjecting precursor diamond grains or powder to HPHT sintering conditions in the presence of a solvent catalyst material that functions to facilitate the bonding together of the diamond grains at temperatures of between about 1,350 to 1,500° C. and pressures of 5,000 Mpa or higher. Suitable solvent catalyst materials useful for making PCD include those metals identified in Group VIII of the Periodic table.

As used herein, the term "thermal characteristics" is understood to refer to the thermal stability of the resulting PCD construction, which can depend on such factors as the relative thermal compatibilities, such as thermal expansion properties, of the materials occupying the different construction material phases.

A feature of PCD constructions of this invention is that they comprise a diamond body that retains the matrix phase of bonded together diamond crystals, but the body has been modified so that it no longer includes the solvent metal catalyst material that was used to facilitate the diamond bonding forming the matrix phase. Rather, the body has been specially treated so that the interstitial regions that previously included the solvent catalyst material are configured into one phase that includes a replacement or noncatalyzing material and another phase that does not include the replacement or noncatalyzing material. As used herein, the term "noncatalyzing material" is understood to refer to materials that are not identified in Group VIII of the Periodic table, and that do not promote the change or interaction of the diamond crystals within the diamond body at temperatures below about 2,000° C.

FIG. 1A schematically illustrates a region 10 of a PCD construction prepared according to principles of this invention that includes the replacement or noncatalyzing material. Specifically, the region 10 includes a material microstructure comprising a plurality of bonded together diamond crystals 12, forming an intercrystalline diamond matrix first phase, and the replacement or noncatalyzing material 14 that is interposed within the plurality of interstitial regions that exist between the bonded together diamond crystals and/or that are attached to the surfaces of the diamond crystals. For purposes of clarity, it is understood that the region 10 of the PCD construction is one taken from a PCD body after it has been modified in accordance with this invention to remove the solvent metal catalyst material used to initially form the PCD.

Figure 1B:
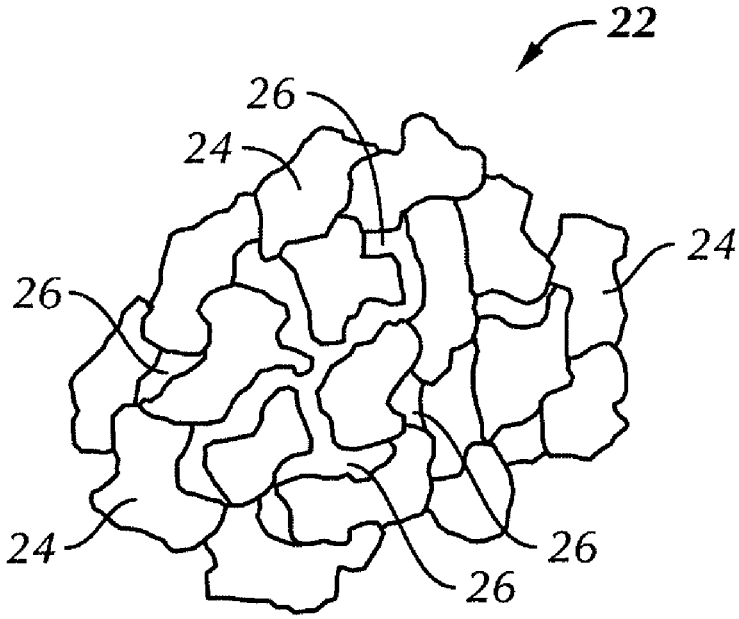
FIG. 1B is a schematic view of a region taken from a polycrystalline diamond body that is substantially free of the second phase material of FIG. 1.

FIG. 1B schematically illustrates a region 22 of a PCD construction prepared according to principles of this invention that is substantially free of the replacement or noncatalyzing material. Like the PCD construction region illustrated in FIG. 1A, the region 22 includes a material microstructure comprising the plurality of bonded together diamond crystals 24, forming the intercrystalline diamond matrix first phase. Unlike the region 10 illustrated in FIG. 1A, this region 22 has been modified to remove the replacement or noncatalyzing material from the plurality of interstitial regions and, thus comprises a plurality of interstitial regions 26 that are substantially free of the replacement or noncatalyzing material. Again, it is understood that the region 22 of the PCD construction is one taken from a PCD body after it has been modified in accordance with this invention to remove the solvent metal catalyst material used to initially form the PCD.

PCD constructions of this invention are provided in the form of a PCD body that may or may not be attached to a substrate. The PCD body may be configured to include the two above-described regions in the form of two distinct portions of the body, or the diamond body can be configured to include the two above-described regions in the form of discrete elements that are positioned at different locations within the body, depending on the particular end-use application.

PCD constructions configured in this matter, having the solvent catalyst material used to form the PCD removed therefrom, and that is further modified to include the two regions described provide improved thermal characteristics to the resulting material microstructure, reducing or eliminating the thermal expansion problems caused by the presence of the solvent metal catalyst material.

Figure 2A:
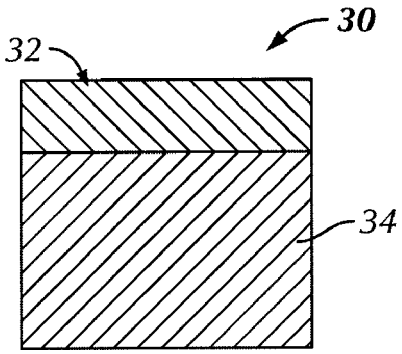
FIGS. 2A to 2I are cross-sectional schematic side views of polycrystalline diamond constructions of this invention during different stages of formation.
Figure 2B:
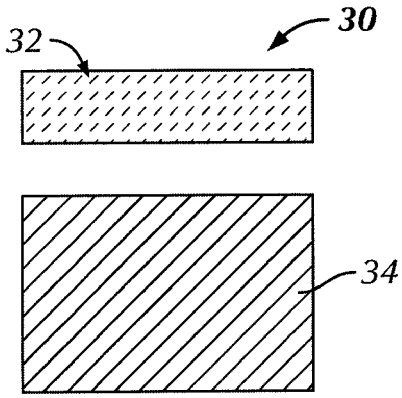
Figure 2C:
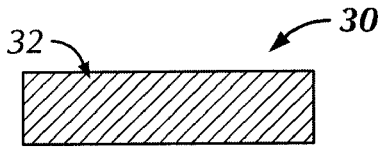

FIGS. 2A, 2B, and 2C each schematically illustrate an example embodiment PCD construction 30 of this invention at different stages of formation. FIG. 2A illustrates a first stage of formation, starting with a conventional PCD body 32 in its initial form after sintering by conventional HPHT sintering process. At this early stage, the PCD body 32 comprises a polycrystalline diamond matrix first phase and a solvent catalyst metal material, such as cobalt, disposed within the interstitial regions between the bonded together diamond crystals forming the matrix. The solvent catalyst metal material can be added to the precursor diamond grains or powder as a raw material powder prior to sintering, it can be contained within the diamond grains or powder, or it can be infiltrated into the diamond grains or powder during the sintering process from a substrate containing the solvent metal catalyst material and that is placed adjacent the diamond powder and exposed to the HPHT sintering conditions. In an example embodiment, the solvent metal catalyst material is provided as an infiltrant from a substrate 34, e.g., a WC—Co substrate, during the HPHT sintering process.

Diamond grains useful for forming the PCD body include synthetic or natural diamond powders having an average diameter grain size in the range of from submicrometer in size to 100 micrometers, and more preferably in the range of from about 1 to 80 micrometers. The diamond powder can contain grains having a mono or multi-modal size distribution. In the event that diamond powders are used having differently sized grains, the diamond grains are mixed together by conventional process, such as by ball or attrittor milling for as much time as necessary to ensure good uniform distribution.

As noted above, the diamond powder may be combined with a desired solvent metal catalyst powder to facilitate diamond bonding during the HPHT process and/or the solvent metal catalyst can be provided by infiltration from a substrate positioned adjacent the diamond powder during the HPHT process. Suitable solvent metal catalyst materials useful for forming the PCD body include those metals selected from Group VIII elements of the Periodic table. A particularly preferred solvent metal catalyst is cobalt (Co), Alternatively, the diamond powder mixture can be provided in the form of a green-state part or mixture comprising diamond powder that is contained by a binding agent, e.g., in the form of diamond tape or other formable/confirmable diamond mixture product to facilitate the manufacturing process. In the event that the diamond powder is provided in the form of such a green-state part it is desirable that a preheating step take place before HPHT consolidation and sintering to drive off the binder material. In an example embodiment, the PCD body resulting from the above-described HPHT process may have a diamond volume content in the range of from about 85 to 95 percent. For certain applications, a higher diamond volume content up to about 98 percent may be desired.

The diamond powder or green-state part is loaded into a desired container for placement within a suitable HPHT consolidation and sintering device. In an example embodiment, where the source of the solvent metal catalyst material is provided by infiltration from a substrate, a suitable substrate material is disposed within the consolidation and sintering device adjacent the diamond powder mixture. In a preferred embodiment, the substrate is provided in a preformed state. Substrates useful for forming the PCD body can be selected from the same general types of materials conventionally used to form substrates for conventional PCD materials, including carbides, nitrides, carbonitrides, ceramic materials, metallic materials, cermet materials, and mixtures thereof. A feature of the substrate used for forming the PCD body is that it include a solvent metal catalyst capable of melting and infiltrating into the adjacent volume of diamond powder to facilitate conventional diamond-to-diamond intercrystalline bonding forming the PCD body. A preferred substrate material is cemented tungsten carbide (WC—Co).

Where the solvent metal catalyst is provided by infiltration from a substrate, the container including the diamond power and the substrate is loaded into the HPHT device and the device is then activated to subject the container to a desired HPHT condition to effect consolidation and sintering of the diamond powder. In an example embodiment, the device is controlled so that the container is subjected to a HPHT process having a pressure of 5,000 Mpa or more and a temperature of from about 1,350° C. to 1,500° C. for a predetermined period of time. At this pressure and temperature, the solvent metal catalyst melts and infiltrates into the diamond powder, thereby sintering the diamond grains to form conventional PCD.

While a particular pressure and temperature range for this HPHT process has been provided, it is to be understood that such processing conditions can and will vary depending on such factors as the type and/or amount of solvent metal catalyst used in the substrate, as well as the type and/or amount of diamond powder used to form the PCD body or region. After the HPHT process is completed, the container is removed from the HPHT device, and the assembly comprising the bonded together PCD body and substrate is removed from the container. Again, it is to be understood that the PCD body can be formed without using a substrate if so desired.

FIG. 2B schematically illustrates an example embodiment PCD construction 30 of this invention after a second stage of formation, specifically at a stage where the solvent catalyst material disposed in the interstitial regions and/or attached to the surface of the bonded together diamond crystals has been removed form the PCD body 32. At this stage of making the PCD construction, the PCD body has a material microstructure resembling region 22 that is illustrated in FIG. 1B, comprising the polycrystalline matrix first phase formed from a plurality of bonded together diamond crystals 24, and interstitial regions 26 that are substantially free of the solvent metal catalyst material.

As used herein, the term "removed" is used to refer to the reduced presence of the solvent metal catalyst material in the PCD body, and is understood to mean that a substantial portion of the solvent metal catalyst material no longer resides within the PCD body. However, it is to be understood that some small trace amounts of the solvent metal catalyst material may still remain in the microstructure of the PCD body within the interstitial regions and/or adhered to the surface of the diamond crystals. Additionally, the term "substantially free", as used herein to refer to the remaining PCD body after the solvent metal catalyst material has been removed, is understood to mean that there may still be some trace small amounts of the solvent metal catalyst remaining within the PCD body as noted above.

The quantity of the solvent metal catalyst material remaining in the material microstructure after the PCD body has been subjected to treatment to remove the same can and will vary on such factors as the efficiency of the removal process, the size and density of the diamond matrix material, or the desired amount of any solvent catalyst material to be retained within the PCD body. For example, it may be desired in certain applications to permit a small amount of the solvent metal catalyst material to stay in the PCD body. In an example embodiment, it is desired that the PCD body comprise no greater than about 1 percent by volume of the solvent metal catalyst material.

In an example embodiment, the solvent metal catalyst material is removed from the PCD body by a suitable process, such as by chemical treatment such as by acid leaching or aqua regia bath, electrochemically such as by electrolytic process, by liquid metal solubility technique, by liquid metal infiltration technique that sweeps the existing second phase material away and replaces it with another during a liquid-phase sintering process, or by combinations thereof. In an example embodiment, the solvent metal catalyst material is removed from all or a desired region of the PCD body by an acid leaching technique, such as that disclosed for example in U.S. Pat. No. 4,224,380, which is incorporated herein by reference.

Referring again to FIG. 2B, at this stage any substrate 34 that was used as a source of the solvent metal catalyst material can be removed from the PCD body 32. If the solvent metal catalyst material was mixed with or otherwise provided with the precursor diamond powder, then the PCD construction 30 at this stage of manufacturing will not contain a substrate, i.e., it will only consist of a PCD body 32.

FIG. 2C schematically illustrates an example embodiment PCD construction 30 prepared according to principles of this invention after a third stage of formation. Specifically, at a stage where the solvent metal catalyst material removed from the PCD body has now been replaced with a replacement material. In the example embodiment noted above, the replacement material is preferably one that: (1) is relatively inert (in that it does not act as a catalyst relative to the polycrystalline matrix first phase at temperatures below about 2,000° C.); and/or (2) enhances one or more mechanical property of the existing PCD body; and/or (3) optionally facilitates attachment of the PCD body to a substrate, thereby forming a compact.

Referring back to FIG. 2B, once the solvent catalyst material is removed from PCD body, the remaining microstructure comprises a polycrystalline matrix first phase with a plurality of interstitial voids 26 forming what is essentially a porous material microstructure. This porous microstructure not only lacks mechanical strength, but also lacks a material constituent that is capable of forming a strong attachment bond with a substrate, e.g., in the event that the PCD construction need to be in the form of a compact comprising such a substrate to facilitate attachment to an end-use device.

The voids or pores in the PCD body can be filled with the replacement material using a number of different techniques. Further, all of the voids or only a portion of the voids in the PCD body can be filled with the replacement material. In an example embodiment, the replacement material can be introduced into the PCD body by liquid-phase sintering under HPHT conditions. In such example embodiment, the replacement material can be provided in the form of a sintered part or a green-state part that is positioned adjacent on or more surfaces of the PCD body, and the assembly is placed into a container that is subjected to HPHT conditions sufficient to melt the replacement material and cause it to infiltrate into the PCD body. In an example embodiment, the source of the replacement material can be a substrate that will be used to form a PCD compact from the PCD construction by attaching to the PCD body during the HPHT process.

Alternatively, the replacement material can be introduced into the PCD body by pressure technique where the replacement material is provided in the form of a slurry or the like comprising a desired replacement material with a carrier, e.g., such as a polymer or organic carrier. The slurry is then exposed to the PCD body at high pressure to cause it to enter the PCD body and cause the replacement material to fill the voids therein. The PCD body can then be subjected to elevated temperature for the purpose of removing the carrier therefrom, thereby leaving the replacement material disposed within the interstitial regions.

The term "filled", as used herein to refer to the presence of the replacement material in the voids or pores of the PCD body presented by the removal of the solvent metal catalyst material, is understood to mean that a substantial volume of such voids or pores contain the replacement material. However, it is to be understood that there may also be a volume of voids or pores within the same region of the PCD body that do not contain the replacement material, and that the extent to which the replacement material effectively displaces the empty voids or pores will depend on such factors as the particular microstructure of the PCD body, the effectiveness of the process used for introducing the replacement material, and the desired mechanical and/or thermal properties of the resulting PCD construction.

In addition to the properties noted above, it is also desired that the replacement material have a melting temperature that is lower than that of the remaining polycrystalline matrix first phase. In an example embodiment, it is desired that the replacement material have a melting/infiltration temperature that is less than about 1,200° C. A desired feature of the replacement material is that it enhances the strength of the matrix first phase. Another desired feature of the replacement material is that it display little shrinkage after being disposed within the matrix to prevent the formation of unfavorable resultant matrix stresses, while still maintaining the desired mechanical and materials properties of the matrix. It is to be understood that the replacement material selected may have one or more of the above-noted features.

Materials useful for replacing the solvent metal catalyst include, and are not limited to non-refractory metals, ceramics, silicon and silicon-containing compounds, ultra-hard materials such as diamond and cBN, and mixtures thereof. Additionally, the replacement material can be provided in the form of a composite mixture of particles and/or fibers. It is to be understood that the choice of material or materials used to replace the removed solvent metal catalyst material can and will vary depending on such factors including but not limited to the end use application, and the type and density of the diamond grains used to form the polycrystalline diamond matrix first phase, and the desired mechanical properties and/or thermal characteristics for the same.

Preferred replacement materials include noncatalyzing materials selected from the Group IB elements of the Periodic table. It is additionally desired that the replacement material display negligible or no solubility for carbon. In an example embodiment, copper (Cu) is a useful replacement material because it is a noncatalyzing material that does not interfere with the diamond bond, has a relatively low melting point, and has a desired degree of mechanical strength.

Additionally, as mentioned above, mixtures of two or more materials can be used as the replacement material for the purpose of contributing certain desired properties and levels of such properties to the resulting PCD construction. For example, in certain applications calling for a high level of thermal transfer capability and/or a high ultra-hard material density, a replacement material made from a mixture of a nonrefractory metal useful as a carrier, and an ultra-hard material can be used. In an example embodiment, a replacement material comprising a mixture of copper, e.g., in the form of copper powder, and diamond, e.g., in the form of ultra-fine diamond grains or particles, can be used to fill the removed solvent metal catalyst material by a liquid phase process as discussed in greater detail below. Additionally, as mentioned above, the replacement material can be provided in the form of a mixture or slurry of the replacement material with a suitable liquid carrier, such as an organic or polymeric material or the like.

In such embodiment, the mixture of copper and diamond grains or particles is placed adjacent the desired surface portion of the PCD body after the solvent metal catalyst material been removed, and the assembly is subjected to HPHT conditions sufficient to cause the copper to melt and infiltrate the matrix, carrying with it the diamond grains or particles to fill the voids or pores in the polycrystalline diamond matrix. The use of an ultra-hard material such as diamond grains as a component of the replacement material helps to both increase the diamond density of PCD body, and is believed to further improvement in the heat transfer capability of the construction. Additionally, the presence of the diamond powder in the replacement material functions to help better match the thermal expansion coefficients of the PCD body with that of the replacement material, thereby enhancing the thermal compatibility between the different material phases and reducing internal thermal stresses.

Accordingly, it is to be understood that this is but one example of how different types of materials can be combined to form a replacement material. Such replacement materials, formed from different materials, can be provided in the form of a single-phase alloy or can be provided having two or more material phases.

Different methods, in accordance with this invention, can be used to introduce the removed solvent metal catalyst material. Example methods include HPHT liquid phase processing, where the replacement material fills the voids via liquid phase infiltration. However, care must be taken to select a replacement material that when used to fill the removed second phase via liquid phase process displays little shrinkage during cooling to prevent unfavorable resultant matrix stresses while maintaining the desired mechanical and material properties of the matrix. Other processes include liquid phase extrusion and solid phase extrusion, induction heating, and hydropiller process.

Example of Liquid Phase Filling

In an example embodiment, wherein the PCD body is treated to remove the solvent metal catalyst material, Co, therefrom, the resulting PCD body was again subjected to HPHT processing for a period of approximately 100 seconds at a temperature below that of the melting temperature of the replacement material, which was copper. The source of the copper replacement material was a WC—Cu substrate that was positioned adjacent a desired surface portion of the PCD body prior to HPHT processing. The HPHT process was controlled to bring the contents to the melting temperature of copper (less than about 1,200° C., at a pressure of about 3,400 to 7,000 Mpa) to infiltrate into and fill the pores or voids in the PCD body. During the HPHT process, the substrate containing the copper material was attached to the PCD body to thereby form a PCD compact.

In addition to the representative processes for introducing the replacement material into the voids or pores of the PCD body, other processes can be used for introducing the replacement material. These processes include, but are not limited to chemical processes, electrolytic processes, and by electrochemical processes.

FIG. 2C illustrates the PCD body 32 as filled with the replacement material, wherein the PCD body is free standing. However, as mentioned above, it is to be understood that the PCD body 32 filled with the replacement material at this stage of processing can be in the form of a compact comprising a substrate attached thereto. The substrate can be attached during the HPHT process used to fill the PCD body with the replacement material. Alternatively, the substrate can be attached separately from the HPHT process used for filling, such as by a separate HPHT process, or by other attachment technique such as brazing or the like.

Once the PCD body 32 has been filled with the replacement material, i.e., a noncatalyzing material, it is then treated to remove a portion of the replacement material therefrom. FIGS. 2D, 2E, 2F and 2G all illustrate representative embodiments of PCD bodies that have been filled and subsequently treated to remove the replacement material from a region therefrom. Techniques useful for removing a portion of the replacement material from the PCD body includes the same ones described above for removing the solvent metal catalyst material from the PCD body, e.g., during the second step of processing such as by acid leaching or the like. In an example embodiment it is desired that the process of removing the replacement material be controlled so replacement material be removed from a targeted region of the PCD body extending a determined depth from one or more PCD body surfaces. These surfaces may include working and/or nonworking surfaces of the PCD body.

In an example embodiment, the replacement material is removed from the PCD body a depth of less than about 0.5 mm from the desired surface or surfaces, and preferably in the range of from about 0.05 to 0.4 mm. Ultimately, the specific depth of the region formed in the PCD body by removing the replacement material will vary depending on the particular end-use application.

Figure 2D:
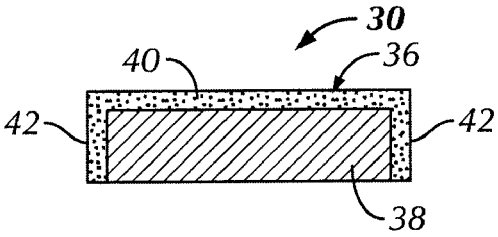

FIG. 2D illustrates an embodiment of the PCD construction 30 comprising the PCD body 32 that includes a first region 36 that is substantially free of the replacement material, and a second region 38 that includes the replacement material. The first region 36 extends a depth from surfaces 40 and 42 of the PCD body, and the second region 38 is remote from the surfaces 40 and 42. In this particular embodiment, the surfaces include a top surface 40 and side surfaces 42 of the PCD body. The depth of the first regions can be the same or different for the surfaces 40 and 42 depending on the particular end-use application. Additionally, the extent of the side surfaces that include the first region can vary from extending along the entire side of the PCD body to extending only along a partial length of the side of PCD body.

Figure 2E:
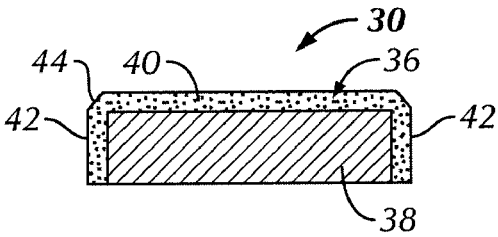

FIG. 2E illustrates an embodiment of the PCD construction 30 that is similar to that illustrated in FIG. 2D except that it includes a beveled or chamfered surface 44 that is positioned along an edge of the PCD body 32, between the top surface 40 and the side surface 42, and that includes the first region. The beveled surface can be formed before or after the PCD body has been treated to form the first region 36. In a preferred embodiment, the beveled region is formed before the PCD body has been treated to form the first region, e.g., by OD grinding or the like.

Figure 2F:
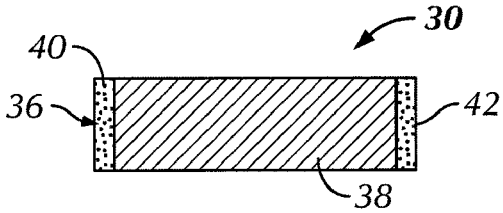

FIG. 2F illustrates another embodiment of the PCD construction 30 of this invention that is similar to that illustrated in FIG. 2D except that the first region 36 is positioned only along the side surface 42 of the PCD body 32 and not along the top surface 40. Thus, in this particular embodiment, the first region is in the form of an annular region that surrounds the second region 38. Again, it is to be understood that the placement position of the first region relative to the second region can and will vary depending on the particular end-use application.

Figure 2G:
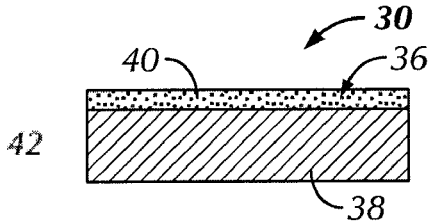

FIG. 2G illustrates another embodiment of the PCD construction 30 of this invention that is similar to that illustrated in FIG. 2D except that the first region 36 is positioned only along the top surface 40 of the PCD body 32 and not along the side surface 42. Thus, in this particular embodiment, the first region is in the form of a disk-shaped region on top of the second region 38.

Figure 2H:
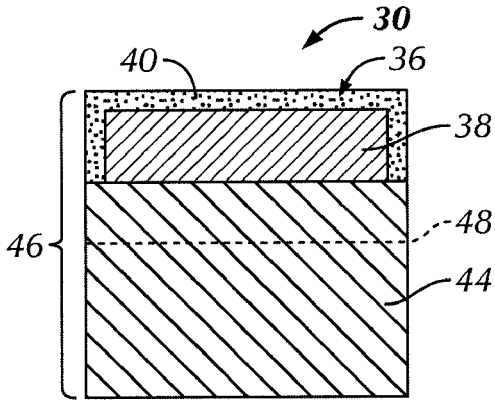
Figure 3:
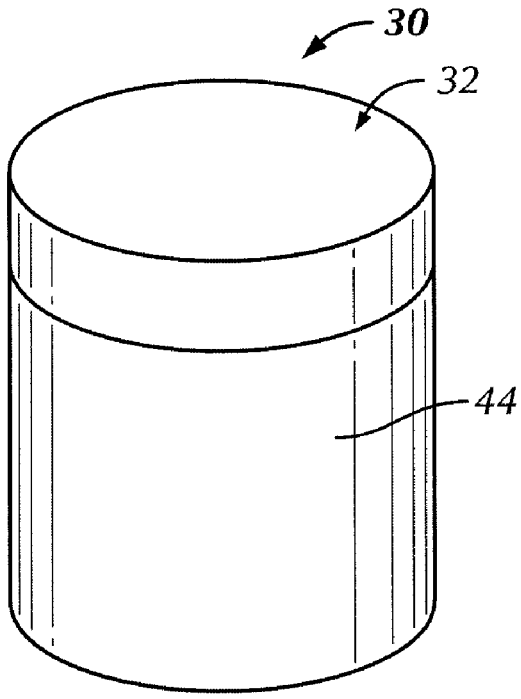
FIG. 3 is a cross-sectional schematic side view of the example embodiment polycrystalline diamond construction of FIG. 2H illustrating the different regions of the polycrystalline diamond body.

FIG. 2H illustrates an embodiment of the PCD construction 30 comprising the PCD body 32 as illustrated in FIG. 2D attached to a desired substrate 44, thereby forming a PCD compact 46. As noted above, the substrate 44 can be attached to the PCD body 32 during the HPHT process that is used during the third step of making the PCD construction, e.g., to infiltrate the replacement material into the PCD body. Alternatively, the replacement material can be added to the PCD body independent of a substrate, in which case the desired substrate can be attached to the PCD body by either a further HPHT process or by brazing, welding, or the like. FIG. 3 illustrates a side view of the PCD construction 30 of FIG. 2H, provided in the form of a compact comprising the PCD body 32 attached to the substrate 44.

In an example embodiment, the substrate used to form the PCD compact is formed from a cermet material that is substantially free of any Group VIII solvent metal catalyst materials. In a preferred embodiment, when the substrate is used as the source of the replacement material, the substrate is formed from a cermet, such as a WC, further comprising a binder material that is the replacement material used to fill the PCD body. Suitable binder materials include Group IB metals of the Periodic table or alloys thereof. Preferred Group IB metals and/or alloys thereof include Cu, Ag, Au, Cu—W, Cu—Ti, Cu—Nb, or the like.

It is preferred that the substrate binder material have a melting temperature that is less than about 1,200° C. This melting temperature criteria is designed to ensure that the binder material in the substrate can be melted and infiltrated into the PCD body during the HPHT process under conditions that will not cause any catalyzing material that may be present in the substrate to melt and possibly enter the PCD body. Thereby, ensuring that the PCD body remain completely free any solvent catalyzing material.

In a preferred embodiment, substrates useful for forming PCD compacts of this invention and providing a source of replacement material comprise WC—Cu or WC—Cu alloy. In such embodiment, the carbide particles used to form the substrate are coated with metals such as Ti, W and others that facilitate wetting of the coated particle by the noncatalyzing material. The carbide particles can be coated using conventional techniques to provide a desired coating thickness that is desired to both provide the necessary wetting characteristic to form the substrate, and to also contribute the desired mechanical properties to the substrate for its intended use as a cutting and/or wear element. In an example embodiment, the grain size of the WC particles in the substrate are in the range of from about 0.5 to 3 micrometers. In such example embodiment, the substrate comprises in the range of from about 10 to 20 percent by volume of the noncatalyzing material, based on the total volume of the substrate.

If desired, the substrate can comprise two or more different regions that are each formed from a different material. For example, the substrate can comprise a first region that is positioned adjacent a surface of the substrate positioned to interface and attached with the PCD body, and a second region that extends below the first region. An interface 48 within the substrate 44 between any two such regions is illustrated in phantom in FIG. 2H. A substrate having this construction can be used, for example, to provide a source of the replacement material to the PCD body, attach the substrate to the PCD body during HPHT processing, and to introduce any mechanical properties to the substrate that may facilitate its attachment to the end-use cutting or wear device. For example, such a substrate construction may comprise a first region formed from WC—Cu or a WC—Cu alloy that is positioned along an interfacing surface with the PCD body, and a second region formed from WC—Co positioned remote from the interfacing surface. Here, the Co in the substrate second region would not melt and not infiltrate into the PCD body so long as the process used to infiltrate the Cu replacement material into the PCD body was conducted at a temperature below about 1,200° C., i.e., below the melting temperature of the Co in the substrate second region.

Although the substrate may be attached to the PCD body during replacement material infiltration, it is also understood that the substrate may be attached to the PCD body after the desired replacement material has been introduced. In such case, replacement material can be introduced into the PCD body by a HPHT process that does not use the substrate material as a source, and the desired substrate can be attached to the PCD body by a separate HPHT process or other method, such as by brazing, welding or the like. The substrate can further be attached to the PCD body before or after the replacement material has been partially removed therefrom.

If the PCD compact is formed by attaching the substrate to the PCD body after introduction of the replacement material, then the substrate does not necessarily have to include a binder phase that meets the criteria of the replacement material, e.g., it does not have to be a noncatalyzing material. However, it may be desired that the substrate include a binder phase that meets the criteria of the replacement material, e.g., is the same as the replacement material in the PCD body, within region of the substrate positioned adjacent the PCD body interface to assist in providing a desired attachment bond therebetween, e.g., by HPHT process or the like.

Substrates useful for attaching to the PCD body already filled with the replacement material include those typically used for forming conventional PCD compacts, such as those described above like ceramic materials, metallic materials, cermet materials, or the like. In an example embodiment, the substrate can be formed from a cermet material such as WC—Co. In the event that the substrate includes a binder material that is a Group VIII element, then it may be desired to use an intermediate material between the substrate and the PCD body.

Figure 2I:
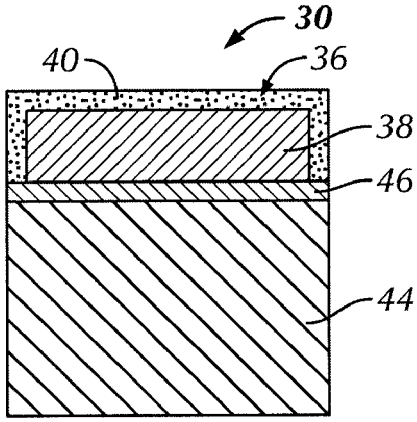
Figure 4:
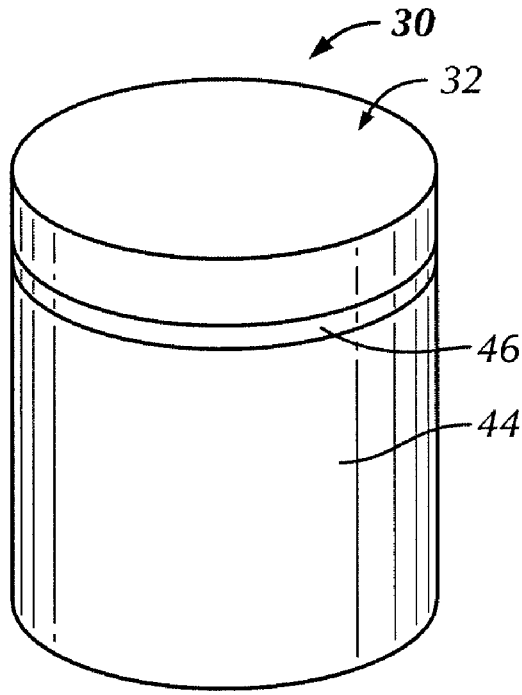
FIG. 4 is a cross-sectional schematic side view of the example embodiment polycrystalline diamond construction of FIG. 2I illustrating the different regions of the polycrystalline diamond body.

FIG. 2I, illustrates an example PCD construction comprising a PCD body 32 including the first and second regions 36 and 38 as described above, wherein the substrate 44 is attached to the PCD body after introduction of the replacement material. In this embodiment, an intermediate material 46 is interposed between the substrate 44 and the PCD body 32. The thickness of the intermediate material can and will vary depending on the type of binder material used in the substrate, the type of replacement material in the PCD body, and the end-use application. FIG. 4 illustrates a side view of the PCD construction 30 of FIG. 2I, provided in the form of a compact comprising the PCD body 32, the substrate 44, and the intermediate material 46 that is interposed therebetween.

The intermediate material can be formed from those materials that are capable of forming a suitable attachment bond between both the PCD body and the substrate. In the event that the substrate material includes a binder material that is a Group VIII element, it is additionally desired that the intermediate material operate as a barrier to prevent or minimize the migration of the substrate binder material into the PCD body during the attachment process. Suitable intermediate materials include those described above as being useful as the replacement material, e.g., can be a noncatalyzing material, and/or can have a melting temperature that is below the melting temperature of any binder material in the substrate. Suitable intermediate materials can be cermet materials comprising a noncatalyzing material such as WC—Cu, WC—Cu alloy, or the like.

In an example embodiment, wherein the substrate and/or intermediate material are subsequently attached to the PCD body, each are provided in a post-sintered form.

Although the interface between the PCD body and the substrate and/or between the PCD body/intermediate material/substrate illustrated in FIGS. 2H and 2I are shown as having a planar geometry, it is understood that these interfaces can also have a nonplanar geometry, e.g., having a convex configuration, a concave configuration, or having one or more surface features that project from one or both of the PCD body and substrate. Such a nonplanar interface may be desired for the purpose of enhancing the surface area of contact between the attached PCD body and substrate, and/or for the purpose of enhancing heat transfer therebetween, and/or for the purpose of reducing the degree of residual stress imposed on the PCD body. Additionally, the PCD body surfaces can be configured differently than that illustrated in FIGS. 2A to 2I, having a planar or nonplanar geometry.

Further, PCD constructions of this invention may comprise a PCD body having properties of diamond density and/or diamond grain size that changes as a function of position within the PCD body. For example, the PCD body may have a diamond density and/or having a diamond grain size that changes in a gradient or step-wise fashion moving away from a working surface of the PCD body. Further, rather than being formed as a single mass, the PCD body used in forming PCD constructions of this invention can be a composite construction formed from a number of PCD bodies that have been combined together, wherein each body can have the same or different properties such as diamond grain size, diamond density, or the like. Additionally, each body can be formed using a different solvent catalyst material that may contribute different properties thereto that may be useful at different locations within the composite PCD body.

PCD constructions of this invention display marked improvements in thermal stability and thus service life when compared to conventional PCD materials that comprise the solvent catalyst material. PCD constructions of this invention can be used to form wear and/or cutting elements in a number of different applications such as the automotive industry, the oil and gas industry, the aerospace industry, the nuclear industry, and the transportation industry to name a few. PCD constructions of this invention are well suited for use as wear and/or cutting elements that are used in the oil and gas industry in such application as on drill bits used for drilling subterranean formations.

Figure 5:
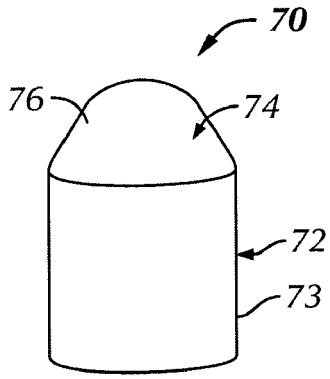
FIG. 5 is a perspective side view of an insert, for use in a roller cone or a hammer drill bit, comprising polycrystalline diamond constructions of this invention.

FIG. 5 illustrates an embodiment of a PCD construction compact of this invention provided in the form of an insert 70 used in a wear or cutting application in a roller cone drill bit or percussion or hammer drill bit used for subterranean drilling. For example, such inserts 70 can be formed from blanks comprising a substrate 72 formed from one or more of the substrate materials 73 disclosed above, and a PCD body 74 having a working surface 76 comprising a material microstructure made up of the polycrystalline diamond matrix phase, a first region comprising the replacement material, and a second region that is substantially free of the replacement material, wherein the first and second regions are positioned within the interstitial regions of the matrix phase. The blanks are pressed or machined to the desired shape of a roller cone rock bit insert.

Although the insert in FIG. 5 is illustrated having a generally cylindrical configuration with a rounded or radiused working surface, it is to be understood that inserts formed from PCD constructions of this invention configured other than as illustrated and such alternative configurations are understood to be within the scope of this invention.

Figure 6:
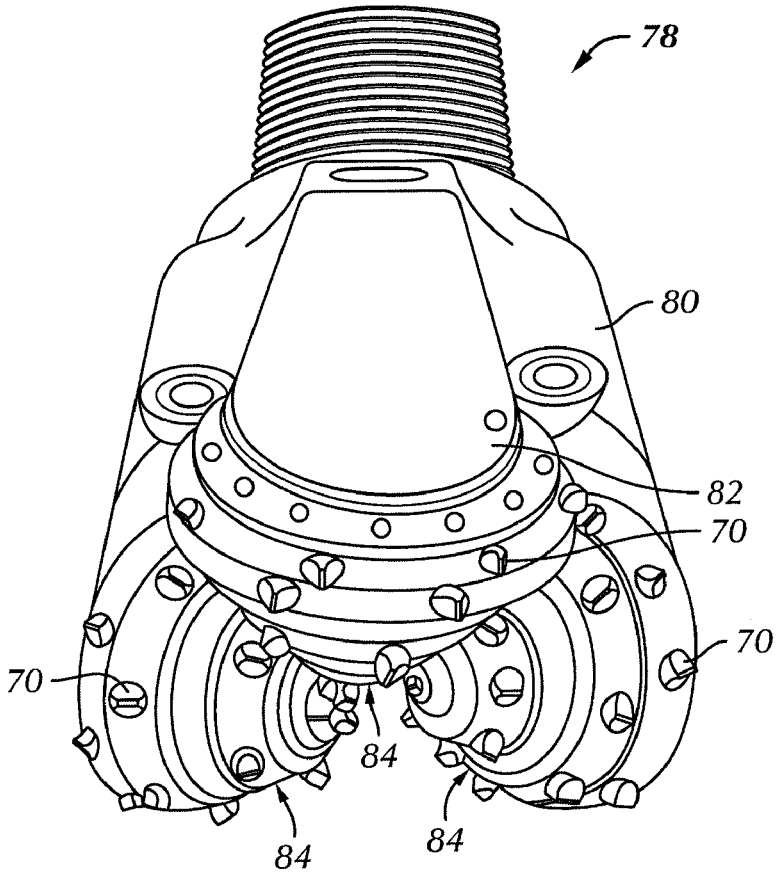
FIG. 6 is a perspective side view of a roller cone drill bit comprising a number of the inserts of FIG. 5.

FIG. 6 illustrates a rotary or roller cone drill bit in the form of a rock bit 78 comprising a number of the wear or cutting inserts 70 disclosed above and illustrated in FIG. 5. The rock bit 78 comprises a body 80 having three legs 82, and a roller cutter cone 84 mounted on a lower end of each leg. The inserts 70 can be fabricated according to the method described above. The inserts 70 are provided in the surfaces of each cutter cone 84 for bearing on a rock formation being drilled.

Figure 7:
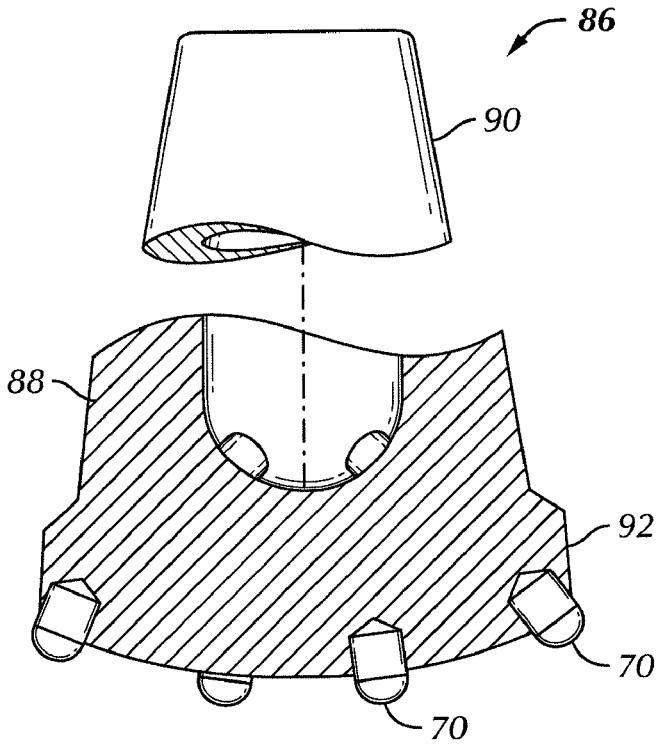
FIG. 7 is a perspective side view of a percussion or hammer bit comprising a number of inserts of FIG. 5.

FIG. 7 illustrates the inserts 70 described above as used with a percussion or hammer bit 86. The hammer bit comprises a hollow steel body 88 having a threaded pin 90 on an end of the body for assembling the bit onto a drill string (not shown) for drilling oil wells and the like. A plurality of the inserts 70 is provided in the surface of a head 92 of the body 88 for bearing on the subterranean formation being drilled.

Figure 8:
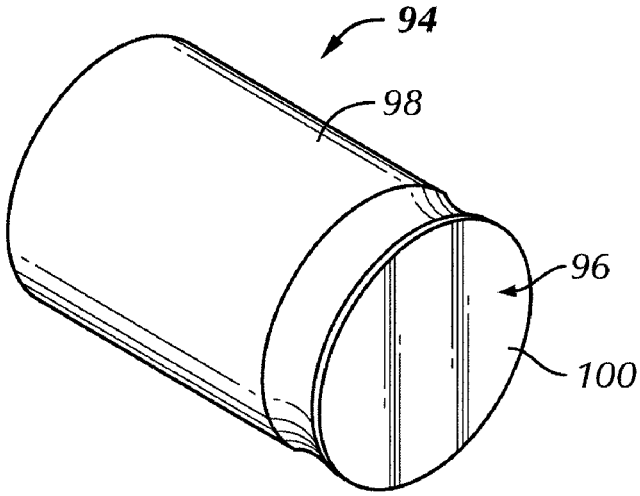
FIG. 8 is a schematic perspective side view of a diamond shear cutter comprising the polycrystalline diamond constructions of this invention.

FIG. 8 illustrates a PCD construction compact of this invention embodied in the form of a shear cutter 94 used, for example, with a drag bit for drilling subterranean formations. The shear cutter 94 comprises a PCD body 96, comprising the polycrystalline diamond matrix phase, a first phase comprising the replacement material, and a second phase that is substantially free of the replacement material, wherein the first and second phases are positioned within the interstitial regions of the matrix. The body is attached to a cutter substrate 98. The PCD body 96 includes a working or cutting surface 100.

Although the shear cutter in FIG. 8 is illustrated having a generally cylindrical configuration with a flat working surface that is disposed perpendicular to an axis running through the shear cutter, it is to be understood that shear cutters formed from PCD constructions of this invention can be configured other than as illustrated and such alternative configurations are understood to be within the scope of this invention.

Figure 9:
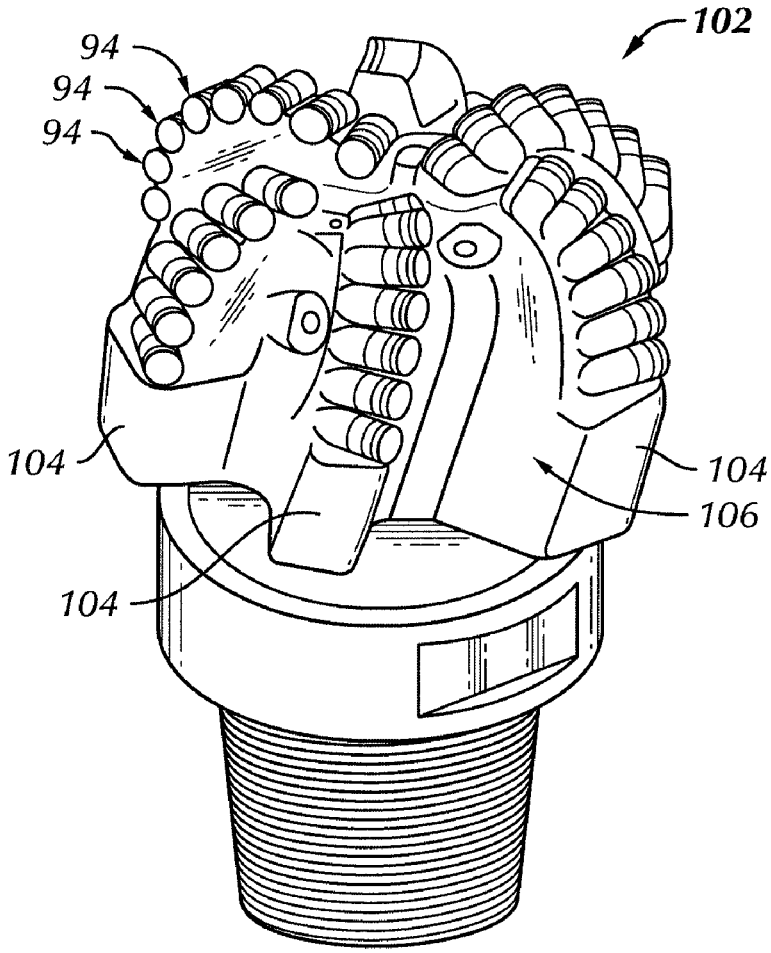
FIG. 9 is a perspective side view of a drag bit comprising a number of the shear cutters of FIG. 8.

FIG. 9 illustrates a drag bit 102 comprising a plurality of the shear cutters 94 described above and illustrated in FIG. 8. The shear cutters are each attached to blades 104 that each extend from a head 106 of the drag bit for cutting against the subterranean formation being drilled.

Other modifications and variations of PCD bodies, constructions, compacts, and methods of forming the same according to the principles of this invention will be apparent to those skilled in the art. It is, therefore, to be understood that within the scope of the appended claims, this invention may be practiced otherwise than as specifically described.

What is claimed is:

1. A polycrystalline diamond construction comprising:

a plurality of bonded together diamond crystals forming a polycrystalline diamond body wherein the diamond body is free of a catalyst material used during the formation of the body and wherein the catalyst material is replaced by a noncatalyzing material, wherein the body includes a surface and comprises:

a first region comprising a noncatalyzing material that is positioned remote from the surface; and a second region that is substantially free of the noncatalyzing material and that extends into the body a depth from the surface;

wherein the surface is selected from the group consisting of a top surface of the body, a side surface of the body, and combinations thereof.

2. The polycrystalline diamond construction as recited in claim 1 wherein the first and second regions occupy interstitial regions between the bonded together diamond grains.

3. The polycrystalline diamond construction as recited in claim 1 wherein the noncatalyzing material has a melting temperature of less than about 1,200° C.

4. The polycrystalline diamond construction as recited in claim 1 wherein the noncatalyzing material is selected from Group IB elements of the Periodic table.

5. The polycrystalline diamond construction as recited in claim 4 wherein the noncatalyzing material is copper.

6. The polycrystalline diamond construction as recited in claim 1 wherein the second region extends from the surface to a depth of less than about 0.5 mm.

7. The polycrystalline diamond construction as recited in claim 1 wherein the surface is a working surface, and the first region extends from the second region to a surface of the body other than the working surface.

8. The polycrystalline diamond construction as recited in claim 1 further comprising a substrate attached to the body, wherein the substrate is positioned adjacent the body first region.

9. The polycrystalline diamond construction as recited in claim 8 wherein the substrate comprises a cermet material and a binder material, and wherein the binder material is formed from the noncatalyzing material.

10. The polycrystalline diamond construction as recited in claim 8 wherein the substrate comprises a cermet material and a binder material, and wherein the binder material is a Group VIII element of the Periodic table.

11. The polycrystalline diamond construction as recited in claim 10 further comprising an intermediate material interposed between the body and the substrate, wherein the intermediate material comprises a Group IB element from the Periodic table.

12. A cutting element attached to a bit for drilling earthen formations, the cutting element being formed from the polycrystalline diamond construction as recited in claim 8.

13. The cutting element as recited in claim 12 wherein the bit comprises a body and a number of legs projecting outwardly therefrom and a number of cones that are rotatably attached to the legs, and wherein the cutting elements are mounted on the cones.

14. The cutting element as recited in claim 12 wherein the bit comprises a body and a number of blades projecting outwardly therefrom, and wherein the cutting elements are mounted on the blades.

15. A polycrystalline diamond construction comprising:

a polycrystalline diamond body comprising a plurality of bonded together diamond crystals forming a matrix phase, and a plurality of interstitial regions interposed between the bonded together diamond crystals, wherein a population of the interstitial regions includes a non-catalyzing material disposed therein that has a melting temperature of less than about 1,200° C., and wherein the body comprises:

a first region comprising the noncatalyzing material that is positioned within the body a distance remote from a working surface of the body; and a second region that is substantially free of the noncatalyzing material and that extends into the body a depth from the working surface;

a substrate that is attached to the body, wherein the substrate is attached adjacent the first region.

16. The polycrystalline diamond construction as recited in claim 15 wherein the noncatalyzing material is selected from Group IB elements of the Periodic table.

17. The polycrystalline diamond construction as recited in claim 16 wherein the noncatalyzing material is copper.

18. The polycrystalline diamond construction as recited in claim 15 wherein the second region extends a depth of less than about 0.5 mm from the working surface.

19. The polycrystalline diamond construction as recited in claim 18 wherein the second region extends a depth of less than about 0.2 mm from the working surface.

20. The polycrystalline diamond construction as recited in claim 15 wherein the substrate is a carbide material comprising a binder material that is the same as the noncatalyzing material.

21. The polycrystalline diamond construction as recited in claim 20 wherein the binder material is positioned adjacent the body, and wherein the substrate comprises a further binder material that is positioned within the substrate remote from the body and that is formed from a material different from the noncatalyzing material.

22. The polycrystalline diamond construction as recited in claim 21 wherein the further binder material comprises a Group VIII element of the Periodic table.

23. The polycrystalline diamond construction as recited in claim 15 further comprising an intermediate material interposed between the body and the substrate, wherein the intermediate material comprises a noncatalyzing material, and wherein the substrate comprises a carbide material that includes a binder selected from Group VIII of the Periodic Table.

24. A bit for drilling earthen formations, the bit including a plurality of cutting elements attached thereto, wherein one or more of the cutting elements comprises a polycrystalline diamond construction comprising:

a polycrystalline diamond body comprising a plurality of bonded together diamond crystals forming a matrix phase, and a plurality of interstitial regions interposed between the bonded together diamond crystals, wherein a population of the interstitial regions includes a non-catalyzing material disposed therein that has a melting temperature of less than about 1,200° C., and wherein the body comprises:

a first region comprising the noncatalyzing material that is positioned within the body a distance remote from a working surface of the body; and a second region that is substantially free of the noncatalyzing material and that extends into the body a depth from the working surface;

a substrate that is attached to the body, wherein the substrate is positioned adjacent the first region.

25. A polycrystalline diamond construction comprising:

a plurality of bonded together diamond crystals forming a polycrystalline diamond body, wherein the diamond body is substantially free of a catalyst material that was used to form the body during high pressure/high temperature processing, the body includes a surface and comprises:

a first region comprising a replacement material that is positioned remote from the surface, and disposed within interstitial regions in the first region; and a second region that is substantially free of the replacement material and that extends into the body a depth from the surface.

26. A bit for drilling earthen formations, the bit including a plurality of cutting elements attached thereto, wherein one or more of the cutting elements comprises a polycrystalline diamond construction comprising:

a polycrystalline diamond body comprising a plurality of bonded together diamond crystals forming a matrix phase, and a plurality of interstitial regions interposed between the bonded together diamond crystals, wherein the body is substantially free of a catalyst material that was used to initially form the body during high pressure/high temperature processing, wherein a population of the interstitial regions includes a replacement material disposed therein, and wherein the body comprises:

a first region comprising the replacement material that is positioned within the body a distance remote from a working surface of the body; and a second region that is substantially free of the replacement material and that extends into the body a depth from the working surface;

a substrate that is attached to the body, wherein the substrate is positioned adjacent the first region.

27. A bit for drilling earthen formations, the bit including a plurality of cutting elements attached thereto, wherein one or more of the cutting elements comprises a polycrystalline diamond construction comprising:

a plurality of bonded together diamond crystals forming a polycrystalline diamond body, wherein the polycrystalline diamond body includes a surface and comprises:

a first region comprising a noncatalyzing material that is positioned remote from the surface; and a second region that is substantially free of the noncatalyzing material and that extends into the polycrystalline diamond body a depth from the surface;

a carbide body that is attached to the polycrystalline diamond body, wherein the carbide body is positioned adjacent the first region, and wherein the carbide body comprises:

a first carbide region comprising a carbide and a binder material that is the same as the noncatalyzing material; and a second carbide region comprising a carbide and a further binder material that is different from the noncatalyzing material;

wherein the second carbide region is positioned within the carbide body remote from the polycrystalline diamond body.

28. The bit as recited in claim 27 wherein the further binder material comprises a Group VIII element of the Periodic table.

29. The bit as recited in claim 27 wherein the first carbide region and the second carbide region are an integral body.

30. The bit as recited in claim 27 wherein the noncatalyzing material has a melting temperature of less than about 1,200° C.

31. The bit as recited in claim 27 wherein the noncatalyzing material is selected from Group IB elements of the Periodic table.

32. The bit as recited in claim 31 wherein the noncatalyzing material is copper.

33. The bit as recited in claim 27 wherein the first carbide region comprises tungsten carbide and copper.

34. The bit as recited in claim 27 wherein the second region extends from the surface to a depth of less than about 0.5 mm.

35. The bit as recited in claim 27 wherein the surface is selected from the group consisting of a top surface of the polycrystalline diamond body, a side surface of the polycrystalline diamond body, and combinations thereof.

36. The bit as recited in claim 27 wherein the surface is a working surface, and the first region extends from the second region to a surface of the polycrystalline diamond body other than the working surface.

37. The bit as recited in claim 27 further comprising an intermediate material interposed between the polycrystalline diamond body and the carbide body, wherein the intermediate material comprises a Group IB element from the Periodic table.

* * * * *